US007133637B2

(12) United States Patent
Lee

(10) Patent No.: US 7,133,637 B2
(45) Date of Patent: Nov. 7, 2006

(54) HEAT ROLLER ASSEMBLY FOR IMAGE FORMING APPARATUS

(75) Inventor: Hyong-gu Lee, Kunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 145 days.

(21) Appl. No.: 10/823,583

(22) Filed: Apr. 14, 2004

(65) Prior Publication Data

US 2004/0253026 A1 Dec. 16, 2004

(30) Foreign Application Priority Data

Jun. 11, 2003 (KR) ..... 10-2003-0037590

(51) Int. Cl.
*G03G 15/20* (2006.01)

(52) U.S. Cl. ..... 399/330

(58) Field of Classification Search ..... 399/328, 399/330

See application file for complete search history.

(56) References Cited

U.S. PATENT DOCUMENTS 5,461,464 A * 10/1995 Swain ..... 399/159
5,579,093 A * 11/1996 Wagner et al. ..... 399/159
5,599,265 A * 2/1997 Foltz ..... 399/159 X
6,963,719 B1 * 11/2005 Jaskowiak ..... 399/330 X
2003/0039493 A1 * 2/2003 Lee ..... 399/330
2003/0091374 A1 * 5/2003 Lee et al. ..... 399/330

FOREIGN PATENT DOCUMENTS

| | | | |
|---|---|---|---|
| JP | 01-057284 A | * | 3/1989 |
| JP | 02-205882 A | * | 8/1990 |
| JP | 5-188817 | | 7/1993 |
| JP | 06-110361 A | * | 4/1994 |
| JP | 8-160793 | | 6/1996 |
| JP | 9-325634 | | 12/1997 |
| JP | 2000-81807 | | 3/2000 |
| KR | 122122 | | 12/1996 |
| KR | 1999-41157 | | 12/1999 |

* cited by examiner

*Primary Examiner*—Sophia S. Chen
(74) *Attorney, Agent, or Firm*—Staas & Halsey LLP

(57) ABSTRACT

An electrophotogrphic image forming apparatus having a fixing unit and a driver rotating the fixing unit, the fixing unit having: a heat roller assembly with a heat roller, a gear cap coupled to an end of the heat roller and transmitting rotation to the heat roller, and an elastic member coupling the gear cap with the heat roller; and a pressing roller pressing a recording medium passing between the pressing roller and the heat roller toward the heat roller, the gear cap having an insertion portion inserted in the heat roller, and a gear portion integrally provided adjacent to the insertion portion and rotated by the driver, and the elastic member being provided between an outer circumferential surface of the insertion portion of the gear cap and an inner circumferential surface of the heat roller, and coupling the gear cap with the heat roller.

26 Claims, 12 Drawing Sheets

HEAT ROLLER ASSEMBLY FOR IMAGE FORMING APPARATUS

CROSS-REFERENCE TO RELATED APPLICATIONS

This application claims the benefit of Korean Patent Application No. 2003-37590, filed Jun. 11, 2003, in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus having an improved structure of a fixing unit to fix a transferred image to a recording medium.

2. Description of the Related Art

An image forming apparatus transfers a digital image signal from a computer or a scanner to a recording medium such as printing paper.

Such an electrophotographic image forming apparatus comprises a photosensitive drum to which an electrostatic latent image is imaged, a developing unit to affix a developer to the photosensitive drum, a transfer roller to transfer the developer affixed to the photosensitive drum to the printing paper, and a fixing unit to fix the transferred developer to the printing paper, thereby printing an image on the printing paper. The electrophotographic image forming apparatus may be a laser beam printer, a light emitting diode (LED) printer, a digital copier, etc.

In the electrophotographic image forming apparatus, the fixing unit comprises a heat roller assembly having a heat roller to fix an image by coming into rolling-contact with the printing paper having the transferred image, and a pressing roller disposed facing the heat roller across the printing paper and pressing the printing paper toward the heat roller.

FIG. 1 is a perspective view of the heat roller assembly of a conventional image forming apparatus. As shown therein, a heat roller assembly 141 comprises a heater (not shown), a heat roller 145 heated by the heater and coming into rolling-contact with printing paper (not shown), a gear cap 151 provided in a first end of the heat roller 145, and an end cap 161 provided in a second end of the heat roller 145.

The heat roller 145 has a cylindrical shape, and is provided with the heater. Further, the heat roller 145 is provided with a coated portion 147, which is coated with a nonconductive material on an outer circumferential surface of the heat roller 145, to be in contact with the printing paper. Further, the first and second ends of the heat roller 145 are formed with female screws 146 to which the gear cap 151 and the end cap 161 are coupled, respectively.

The gear cap 151 comprises an insertion portion 152 formed with a male screw on an outer circumferential surface thereof to be coupled to the first end of the heat roller 145, and a gear portion 155 provided in an outside of the insertion portion 152 and formed with a toothed circumference.

Like the gear cap 151, the end cap 161 comprises an insertion portion 152 formed with a male screw on an outer circumferential surface thereof to be coupled to the second end of the heat roller 145.

Thus, the gear cap 151 and the end cap 161 are coupled to the first and second ends of the heat roller 145, respectively.

But in the heat roller assembly 141 of the fixing unit provided in the conventional image forming apparatus, the gear cap 151 and the end cap 161 are screw-coupled to the first and second ends of the heat roller 145, respectively. Therefore, when the printing paper is jammed between the heat roller 145 and the pressing roller (not shown), the gear cap 151 and the end cap 161 are likely to be loosened or separated from the heat roller 145 by a backlash of the heat roller 145.

Also, the heat roller 145 is manufactured to be thin to increase conductivity of heat dissipated from the heater, so that it is difficult to form the female screws on the opposite ends of the thin heat roller 145. Therefore, it is not easy to couple the gear cap 151 and the end cap 161 to the heat roller 145.

SUMMARY OF THE INVENTION

Accordingly, it is an aspect of the present invention to provide an image forming apparatus comprising a heat roller assembly which is easily assembled and prevents a gear cap from breakaway.

Additional aspects and/or advantages of the invention will be set forth in part in the description which follows and, in part, will be obvious from the description, or may be learned by practice of the invention.

The foregoing and/or other aspects of the present invention are achieved by providing an electrophotogrphic image forming apparatus comprising a fixing unit and a driver rotating the fixing unit, the fixing unit comprising: a heat roller assembly comprising a heat roller, a gear cap coupled to a first end of the heat roller and transmitting rotation to the heat roller, and an elastic member coupling the gear cap with the heat roller; and a pressing roller pressing a recording medium passing between the pressing roller and the heat roller toward the heat roller, the gear cap comprising an insertion portion to be inserted in the heat roller, and a gear portion integrally provided on an outside of the insertion portion and rotated by the driver, and the elastic member being provided between an outer circumferential surface of the insertion portion of the gear cap and an inner circumferential surface of the heat roller, and coupling the gear cap with the heat roller.

According to an aspect of the invention, the elastic member forms a pair, and in the outer circumferential surface of the insertion portion of the gear cap, there is positioned a pair of elastic member accommodating parts, to accommodate the pair of elastic members.

According to an aspect of the invention, at least one of the pair of the elastic members comprises an elastic portion accommodated in the elastic member accommodating part of the insertion portion and elastically pressed by the heat roller; bending portions positioned on opposite ends of the elastic portion, which when installed in the heat roller assembly, are bent toward the heat roller; and a locking portion provided in an end of the bending portion and contacting the inner circumferential surface of the heat roller by an elasticity of the elastic portion.

According to an aspect of the invention, the locking portion is hook-shaped to prevent the gear cap from breaking away from the heat roller and prevent the gear cap from rotating relative to the heat roller.

According to an aspect of the invention, the locking portion comprises material with a hardness higher than material of the inner circumferential surface of the heat roller.

According to an aspect of the invention, in the first end of the heat roller, the heat roller has a projection accommodating part positioned in a lengthwise direction of the heat roller, and the gear cap is provided with a projection to be accommodated in the projection accommodating part.

According to an aspect of the invention, the heat roller assembly comprises an end cap coupled by a second elastic member to a second end of the heat roller.

According to an aspect of the invention, at least one of the pair of the elastic members further comprises at least one protrusion provided on the elastic portion between the pair of bending portions and protruding toward the heat roller 45.

According to an aspect of the invention, the protrusion is bent from the elastic portion and contacts the inner circumferential surface of the heat roller to press the elastic portion.

BRIEF DESCRIPTION OF THE DRAWINGS

These and/or other aspects and advantages of the present invention will become apparent and more readily appreciated from the following description of the embodiments, taken in conjunction with the accompany drawings, of which.

DETAILED DESCRIPTION OF THE PREFERRED EMBODIMENTS

Figure 1:
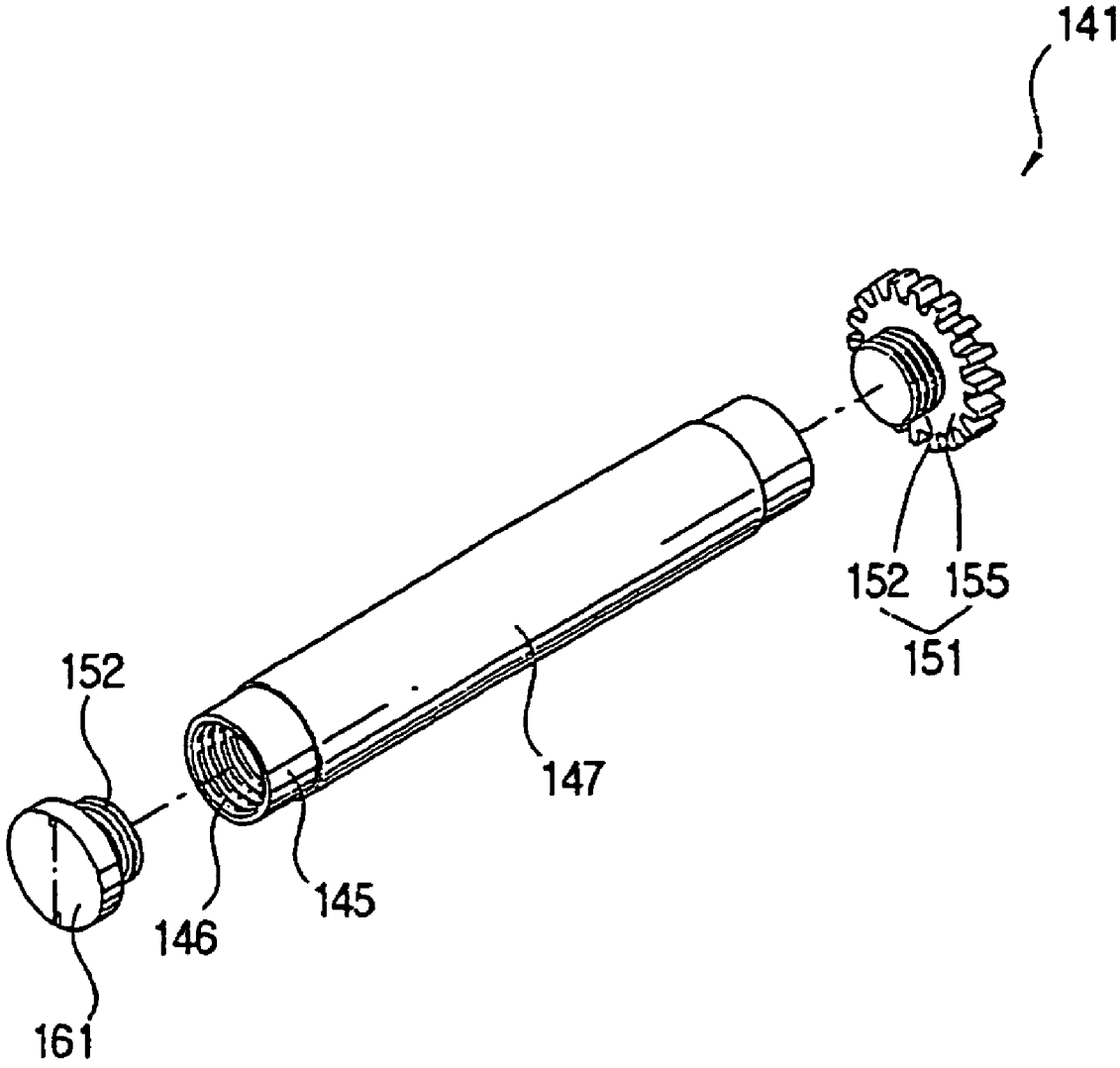
FIG. 1 (PRIOR ART)
FIG. 1 is a perspective view of a heat roller assembly of a conventional image forming apparatus.
Figure 2:
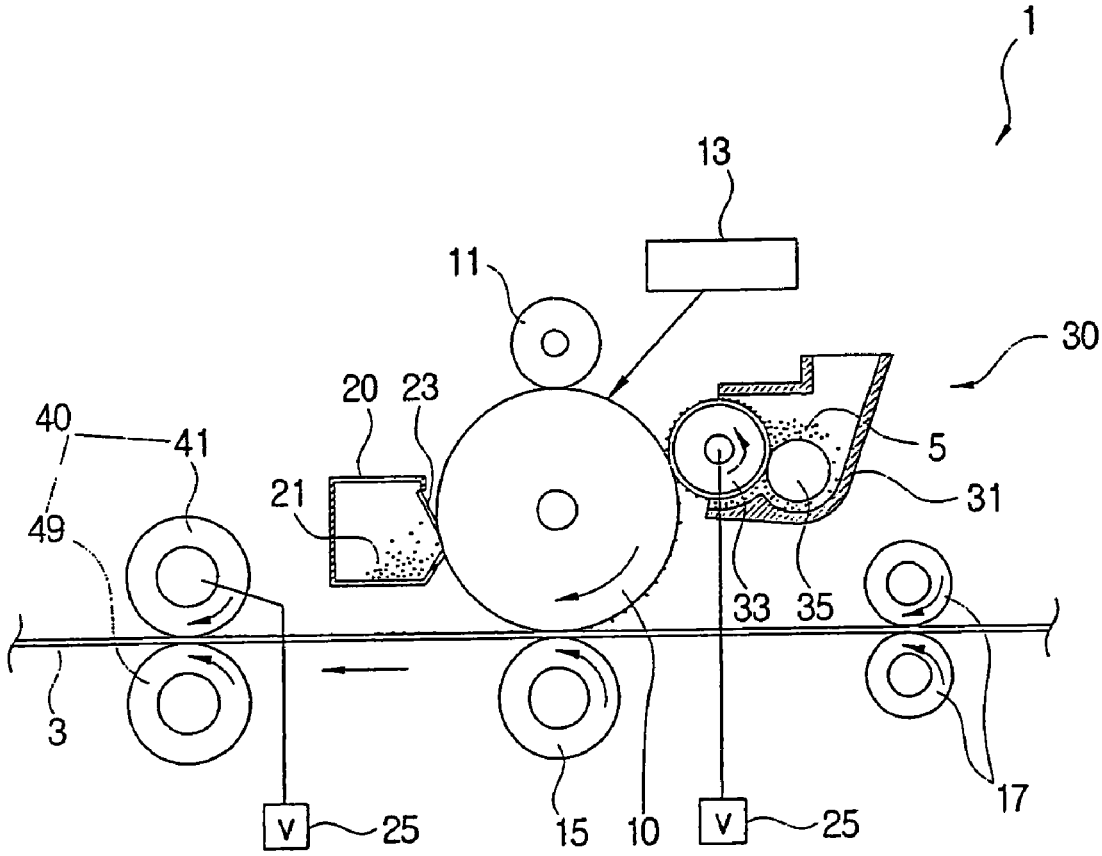
FIG. 2 is a schematic view of an image forming apparatus according to a first embodiment of the present invention.
Figure 3A:
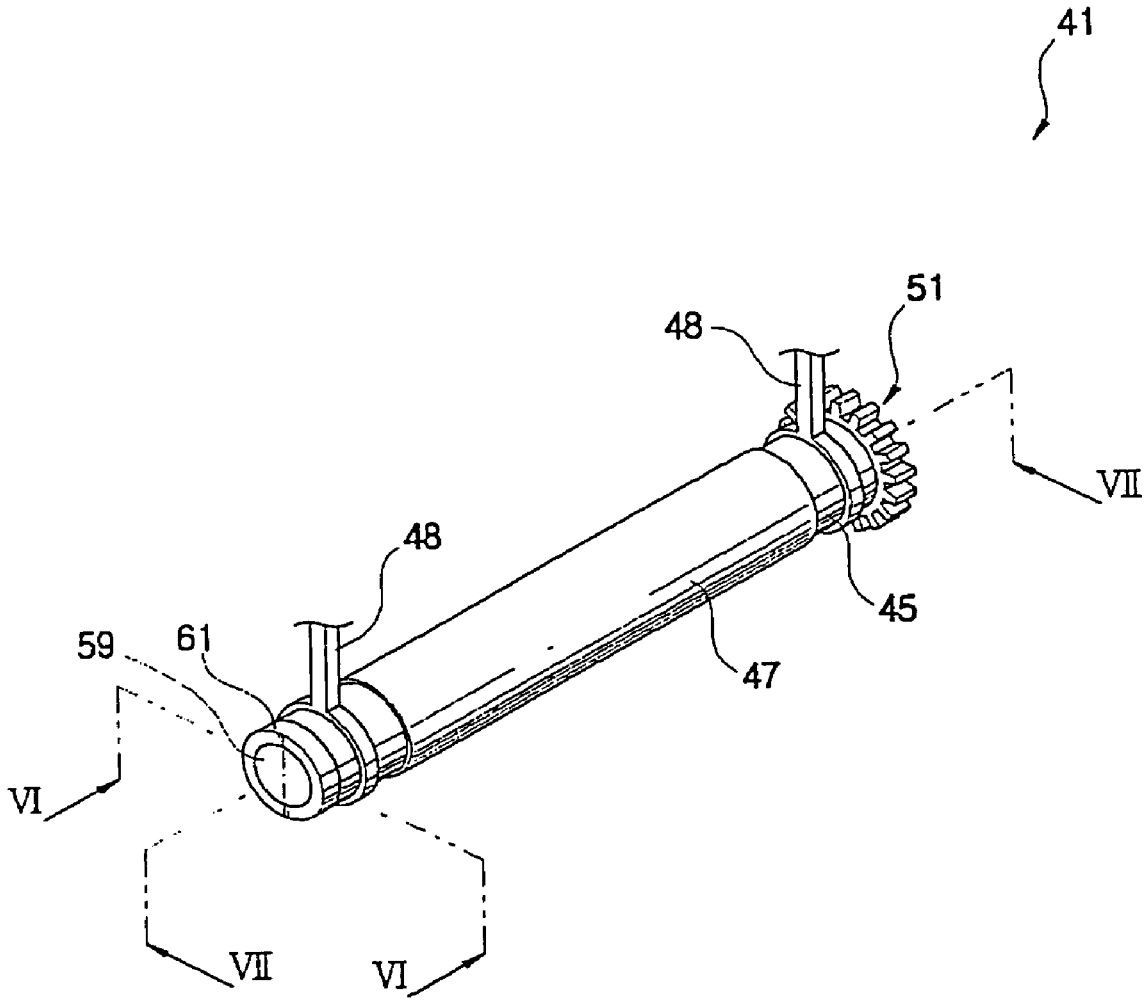
FIGS. 3A and 3B are perspective views of a heat roller assembly of FIG. 2.
Figure 3B:
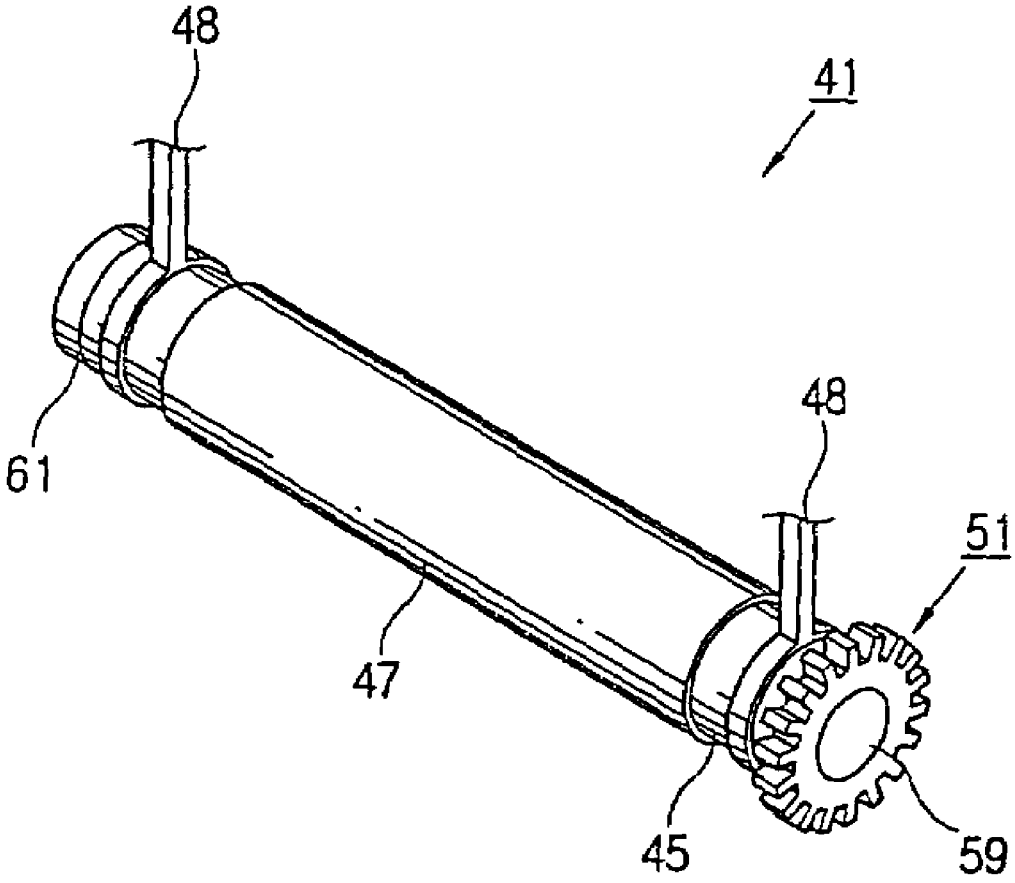
Figure 4:
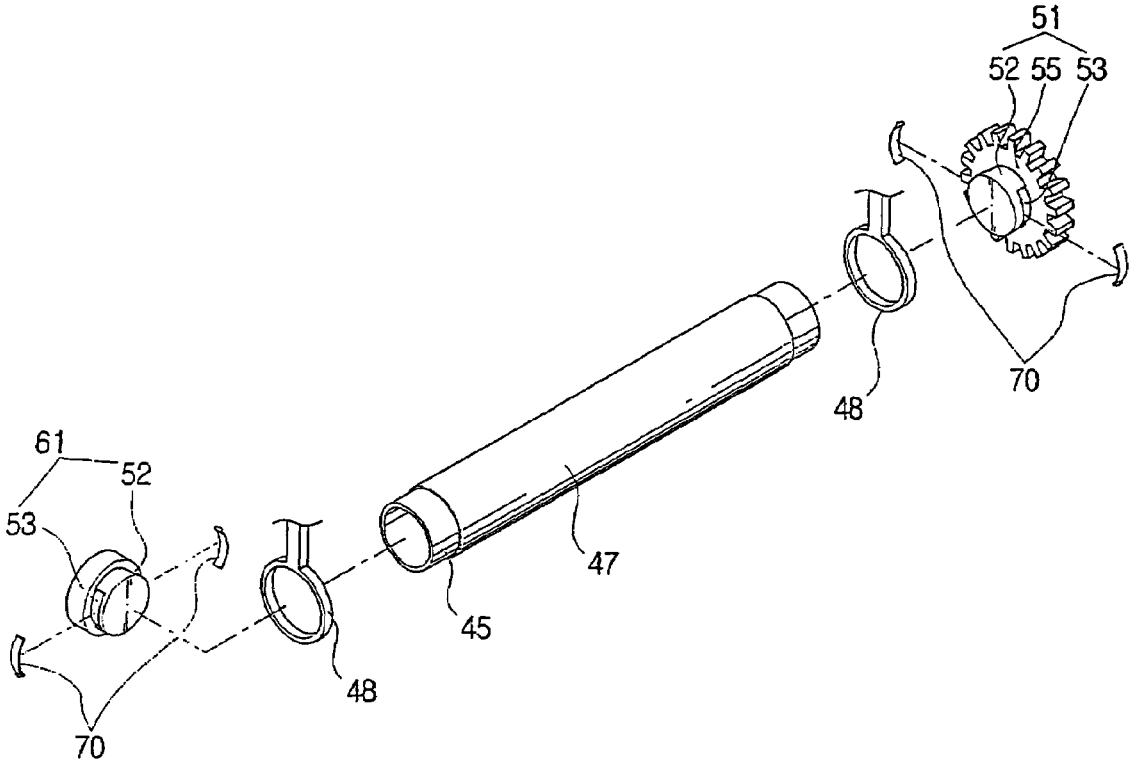
FIG. 4 is an exploded perspective view of the heat roller assembly of the image forming apparatus of FIG. 2.
Figure 5:
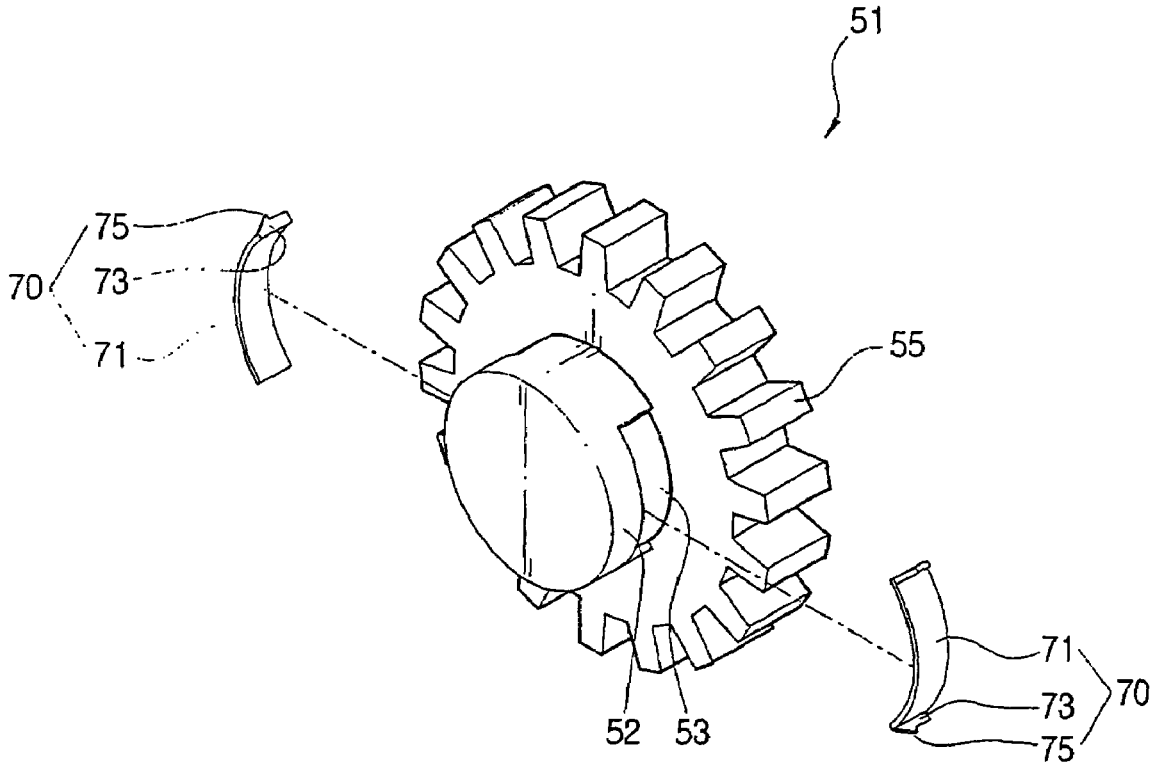
FIG. 5 is a partially enlarged perspective view of the heat roller assembly of the image forming apparatus of FIG. 2.

Reference will now be made in detail to the embodiments of the present invention, examples of which are illustrated in the accompanying drawings, wherein like reference numerals refer to like elements throughout. The embodiments are described below to explain the present invention by referring to the figures.

First Embodiment

As is shown in FIGS. 2 through 5, an image forming apparatus 1 according to a first embodiment of the present invention comprises: a photosensitive drum 10 to which an electrostatic latent image is imaged; an electrical charging roller 11 electrically uniformly charging a surface of the photosensitive drum 10; an optical unit 13 changing a video signal into an optical signal and imaging the electrostatic latent image onto the photosensitive drum 10; a developing unit 30 affixing a developer 5 onto the photosensitive drum 10; a transfer roller 15 transferring the developer 5 affixed onto the photosensitive drum 10 to a printing paper 3 used as a recording medium; a waste developer reservoir 20 having a cleaning blade 23 and storing a residual developer 21 removed from the photosensitive drum 10 after the developer 5 is transferred onto the printing paper 3; a feed roller 17 feeding the printing paper 3 to the transfer roller 15; a fixing unit 40 fixing the developer 5 transferred corresponding to the electrostatic latent image to the printing paper 3; and a power supply 25 supplying power to the developing unit 30 and the fixing unit 40.

The photosensitive drum 10 has a cylindrical shape and is rotatable, wherein the optical unit 13 images the electrostatic latent image onto a surface of the photosensitive drum 10. The photosensitive drum 10 is sprinkled with the developer 5 by a developing roller 33 (to be described later) of the developing unit 30, and transfers the affixed developer 5 to the printing paper 3 fed by the feed roller 17.

The developing unit 30 comprises: a developer cartridge 31 containing the developer 5, the developing roller 33 carrying the developer 5 contained in the developer cartridge 31 to the photosensitive drum 10, and a supplying roller 35 supplying the developer 5 to the developing roller 33.

The power supply 25 supplies the power to the developing roller 33 to carry the developer 5 from the developing roller 33 of the developing unit 30 toward the electrostatic latent image formed on the photosensitive drum 10, and supplies the power to a heater 43 of the fixing unit 40 (to be described later).

The fixing unit 40 comprises: a heat roller assembly 41 fixing an image by coming into rolling-contact with the printing paper having the transferred image, and a pressing roller 49 positioned facing the heat roller across the printing paper 3 and pressing the printing paper 3 toward the heat roller assembly 41.

The heat roller assembly 41 comprises: the heater 43, a heat roller 45 heated by the heater 43 and coming into rolling-contact with the printing paper 3 having the transferred image, a gear cap 51 coupled to a first end of the heat roller 45 and transmitting rotation to the heat roller 45, and an elastic member 70 coupling the gear cap 51 with the heat roller 45. Further, the heat roller assembly 41 comprises: an end cap 61 coupled to a second end of the heat roller 45 by the elastic member 70. Still further, the heat roller assembly 41 comprises: a pair of bushings 48 rotatably connected to the heat roller 45 and rotatably supporting the heat roller 45.

The heater 43 is a heat source such as a hot wire and a halogen lamp, and is provided inside the heat roller 45, thereby generating heat enough to melt the developer 5 transferred to the printing paper 3.

The heat roller 45 has a cylindrical shape, and the first and second ends thereof are opened. Further, the heat roller 45 is provided with the heater 43 thereinside, and comprises a coated portion 47, which is coated with a nonconductive material on an outer circumferential surface of the heat roller 45, to be in contact with the printing paper 3. According to one aspect, the heat roller 45 is made of aluminum having good heat conductivity properties, to increase conductivity for heat dissipated from the heater 43. According to another aspect, the heat roller 45 is made of another material having good heat conductivity properties.

The gear cap 51 comprises: an insertion portion 52 to be inserted in the heat roller 45, and a gear portion 55 integrally provided in an outside of the insertion portion 52 and formed with a toothed circumference to be rotated by a driver (not shown). Further, the gear cap 51 is inserted in and coupled to the first end of the heat roller 45. According to one aspect, the gear cap 51 has an electrode 59 to supply power to the heater 43.

The insertion portion 52 is insertable in an inner circumferential surface of the first end of the heat roller 45, and is formed with a pair of elastic member accommodating parts 53 on an outer circumferential surface of the insertion portion 52 to accommodate the elastic member 70. According to an aspect of the invention, each elastic member accommodating part 53 is formed by recessing a portion of the outer circumferential surface of the insertion portion 52. In the first embodiment, there is the pair of elastic member accommodating parts 53. According to different aspects of the present invention, the number of elastic member accommodating parts may vary corresponding to the number of the elastic members 70, which may be one, two, or at least three.

The gear portion 55 has a toothed circumference that is integrally provided outside the insertion portion 52, and has a diameter larger than that of the insertion portion 52. Further, the gear portion 55 is rotated by a driver (not shown), such as a motor, and transmits rotation to the heat roller 45 coupled to the insertion portion 52.

Like the gear cap 51, according to one aspect, the end cap 61 is coupled to the second end of the heat roller 45 by the elastic member 70. Further, like the gear cap 51, according to one aspect, the end cap 61 comprises an insertion portion 52 to be coupled to the second end of the heat roller 45. Still further, according to one aspect, the insertion portion 52 of the end cap 61 is formed with an elastic member accommodating part 53 to accommodate the elastic member 70. Yet further still, according to one aspect, the end cap 61 comprises an outer portion having a diameter larger than that of the insertion portion 52. Additionally, according to one aspect, the end cap 61 has an electrode 59 to supply power to the heater 43.

The elastic member 70 is provided between the outer circumferential surface of the insertion portion 52 of the gear cap 51 and the inner circumferential surface of the heat roller 45, and couples the gear cap 51 with the heat roller 45. Further, the elastic member 70 is provided between the outer circumferential surface of the insertion portion 52 of the end cap 61 and the inner circumferential surface of the heat roller 45, and couples the end cap 61 with the heat roller 45. In the first embodiment, there are a pair of elastic members 70 oppositely provided in the insertion portions 52 of both the gear cap 51 and the end cap 61. According to various other aspects of the invention, the number of elastic members provided in the gear cap 51 and the end cap 61 may be one, or at least three.

The elastic member 70 comprises: an elastic portion 71 accommodated in the elastic member accommodating part 53 of the insertion portion 52 and elastically pressed by the heat roller 45 a bending portion 73 bent toward the heat roller 45 in opposite ends of the elastic portion 71, and a locking portion 75 provided in an end of the bending portion 73 and contacting the inner circumferential surface of the heat roller 45 by an elasticity of the elastic portion 71.

According to an aspect of the invention, the elastic portion 71 has an arced shape to be accommodated in the elastic member accommodating parts 53. According to one aspect, the arc of the elastic member 71 has a radius larger than an inner radius of the heat roller 45.

Figure 6:
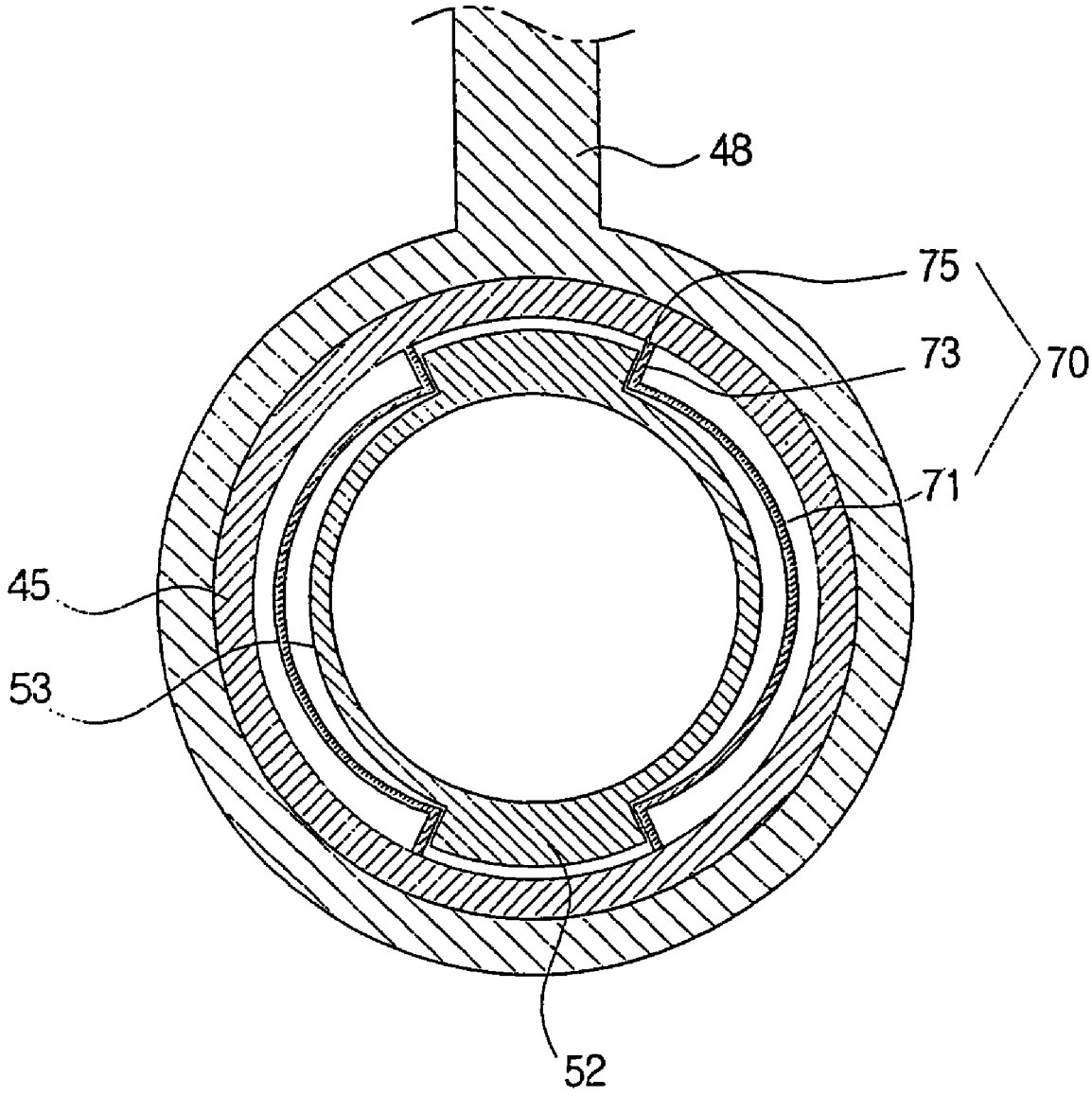
FIG. 6 is a sectional view of the heat roller assembly of the image forming apparatus, taken along line VI—VI in FIG. 3.

According to an aspect of the invention, the bending portion 73 is provided in a pair, which are perpendicularly bent with respect to opposite ends of the elastic portion 71, each of the pair of bending portions 73 having a length long enough to be exposed to an outside of the elastic member accommodating part 53 while being accommodated in the elastic member accommodating part 53. That is, the length of a bending portions 73 is longer than a depth of the elastic member accommodating part 53 (refer to FIG. 6).

Figure 7:
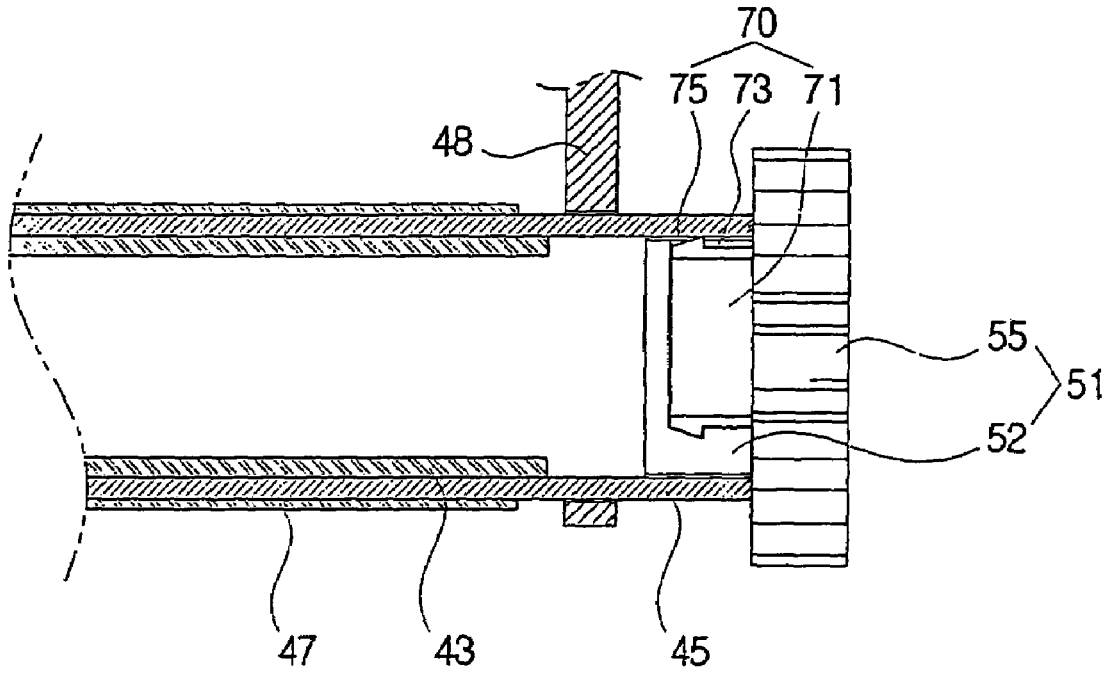
FIG. 7 is a sectional view of the heat roller assembly of the image forming apparatus, taken along line VII—VII in FIG. 3.

According to an aspect of the invention, the locking portion 75 is sharply formed in the end of the bending portions 73 and is shaped like a hook, to prevent the gear cap 51 and the end cap 61 from breaking away from the heat roller 45 or rotating relative to the heat roller 45 after the gear cap 51 and the end cap 61 are coupled to the heat roller 45 (refer to FIG. 7). Further, the end of the locking portion 75 is exposed to the outside of the elastic member accommodating part 53 while the elastic portion 71 is accommodated in the elastic member accommodating part 53, and contacts the inner circumferential surface of the heat roller 45 while the insertion portion 52 is inserted in the heat roller 45.

According to one aspect, the locking portion 75 is made of a material having a hardness higher than that of the inner circumferential surface of the heat roller 45. According to one aspect, the heat roller 45 is made of the aluminum, and the locking portion 75 is made of steel having a hardness higher than that of the aluminum. Further, when the inserting portion 52 is inserted into the heat roller 45, the locking portion 75 forms an acute angle with the inner circumferential surface of the heat roller 45, with respect to a direction of inserting the elastic member 70 into the heat roller 45, thereby allowing the elastic member 70 to be easily inserted in the heat roller 45. Additionally, the locking portion 75 forms an obtuse angle with the inner circumferential surface of the heat roller 45, with respect to a direction of separating the elastic member 70 from the heat roller 45, thereby preventing the elastic member 70 from separating from the heat roller 45. Additionally, the locking portion 75 is sharply formed, and is impacted to the inner circumferential surface of the heat roller 45 by the elasticity of the elastic portion 71, so that the gear cap 51 and the end cap 61 rotate integrally with the heat roller 45.

With this configuration of the image forming apparatus 1 according to the first embodiment of the present invention, the heat roller assembly 41 of the fixing unit 40 is assembled as follows.

First, the elastic members 70 are accommodated in the elastic member accommodating parts 53 provided in each insertion portion 52 of the gear and end caps 51 and 61. Then, the insertion portions 52 of the gear and end caps 51 and 61 are inserted in the first and second ends of the heat roller 45, respectively. At this time, the locking portion 75 of the elastic member 70 contacts the inner circumferential surface of the heat roller 45, and, at the same time, the opposite ends of the elastic portion 71 having the arc shape are inwardly pressed (refer to FIG. 6). Here, the elastic portion 71 has the elasticity to restore to its original shape, and the elasticity of the elastic portion 71 presses the locking portion 75 toward the inner circumferential surface of the heat roller 45. Further, because the locking portion 75 is preferably made of material having the hardness higher than that of the inner circumferential surface of the heat roller 45, the locking portion 75 is thrust and impacted into the inner circumferential surface of the heat roller 45 (refer to FIG. 7).

Thus, in the image forming apparatus 1 according to the first embodiment of the present invention, the heat roller assembly 41 of the fixing unit 40 is easily assembled, and the insertion portions 52 of the gear and end caps 51 and 61, are prevented from being separated from the heat roller 45 and rotating relative to the heat roller 45.

Second Embodiment

Figure 8:
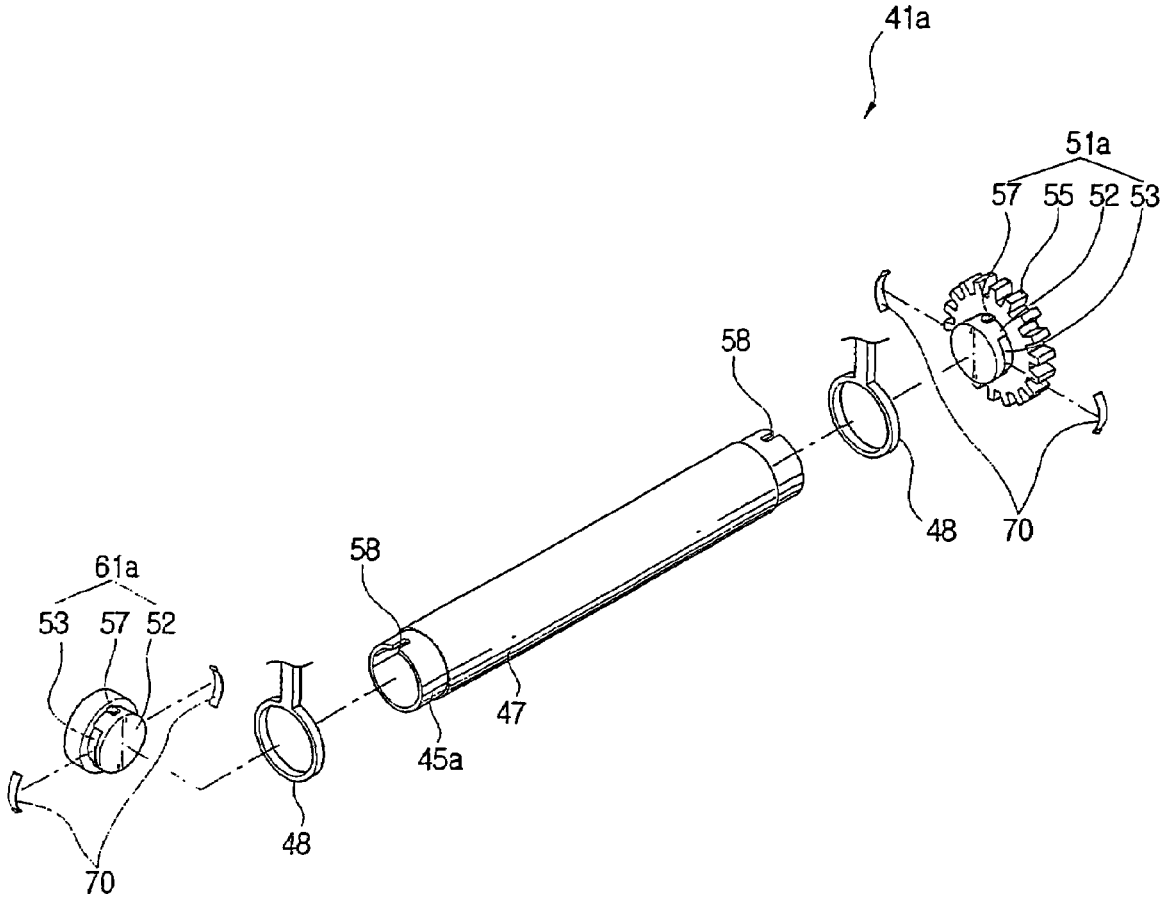
FIG. 8 is a perspective view of a heat roller assembly of an image forming apparatus according to a second embodiment of the present invention.

FIG. 8 is a perspective view of a heat roller assembly 41*a* of a fixing unit provided in an image forming apparatus according to a second embodiment of the present invention.

As is shown in FIG. 8, a projection accommodating part 58 having a predetermined length is formed in a first end of a heat roller 45*a* in a lengthwise direction of the heat roller 45*a,* and a projection 57 is provided in a gear cap 51*a* and accommodated in the projection accommodating part 58.

According to an aspect of the invention, the projection 57 is provided in an end cap 61*a,* and the projection accommodating part 58 is formed in a second end of the heat roller 45*a* to accommodate the projection 57 provided in the end cap 61*a*.

Thus, the aspects of the present invention are achieved by providing the image forming apparatus according to the second embodiment, wherein the gear cap 51*a* and the end cap 61*a* are further prevented from rotating relative to the heat roller 45*a*.

Third Embodiment

Figure 9:
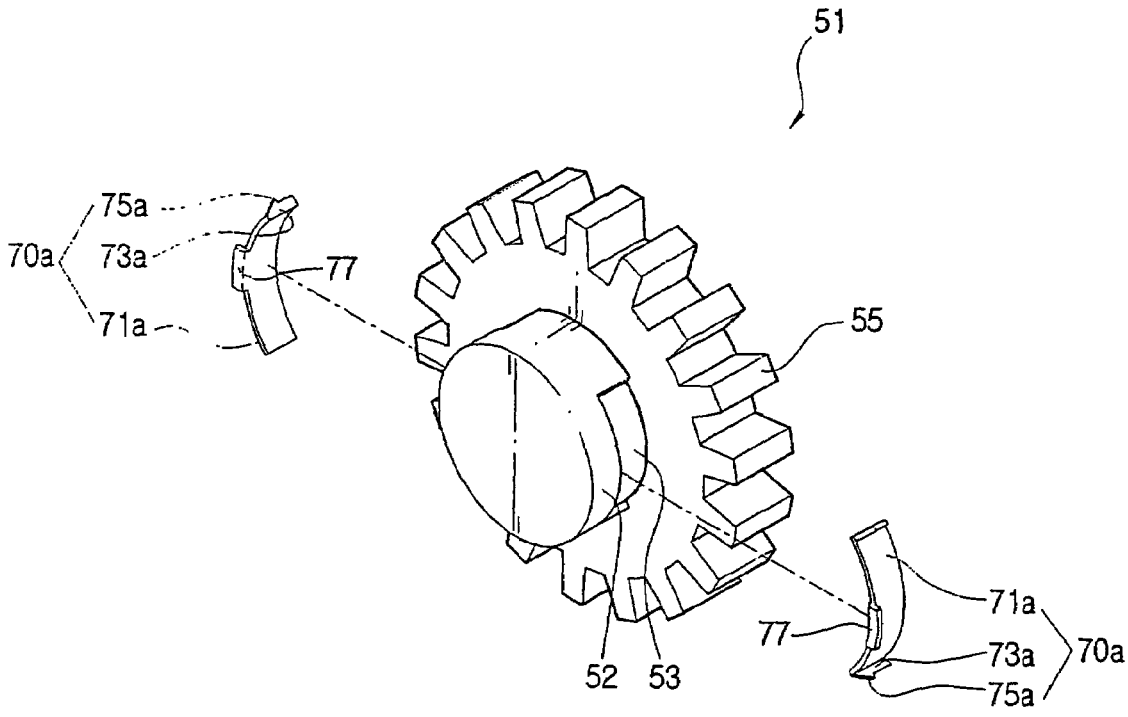
FIGS. 9 and 10 are a partially enlarged perspective view of a heat roller assembly of an image forming apparatus according to a third embodiment of the present invention.
Figure 10:
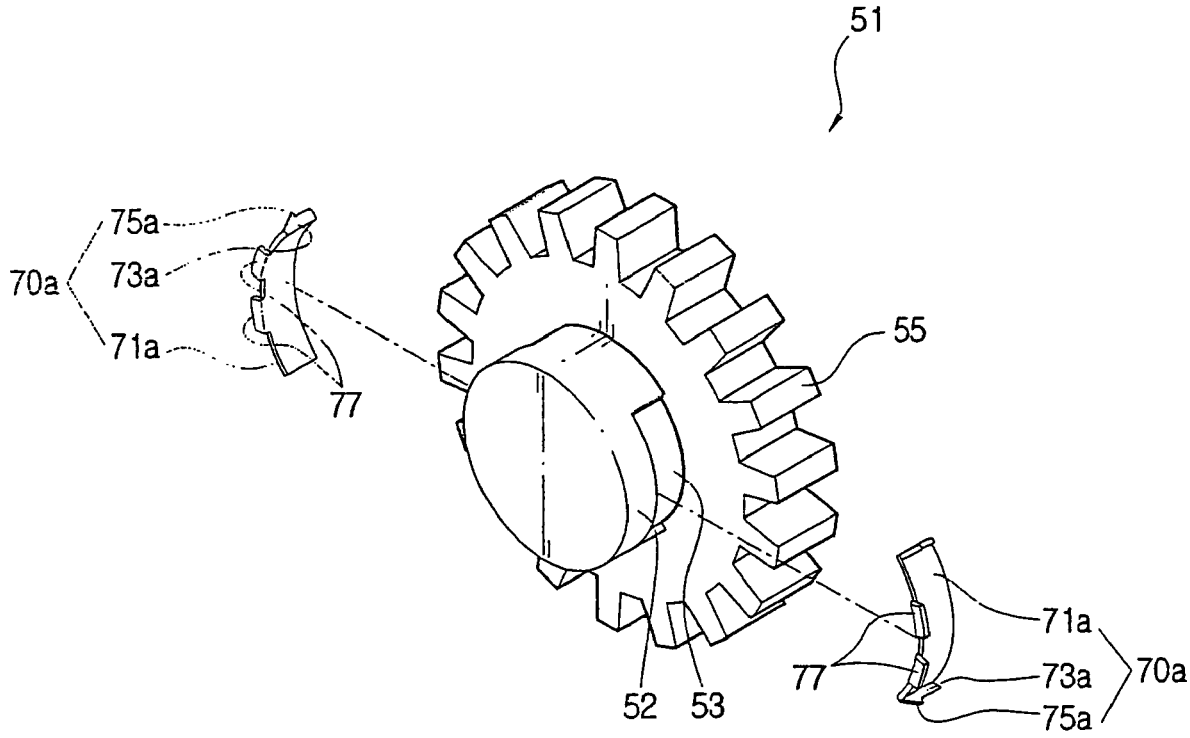
Figure 11:
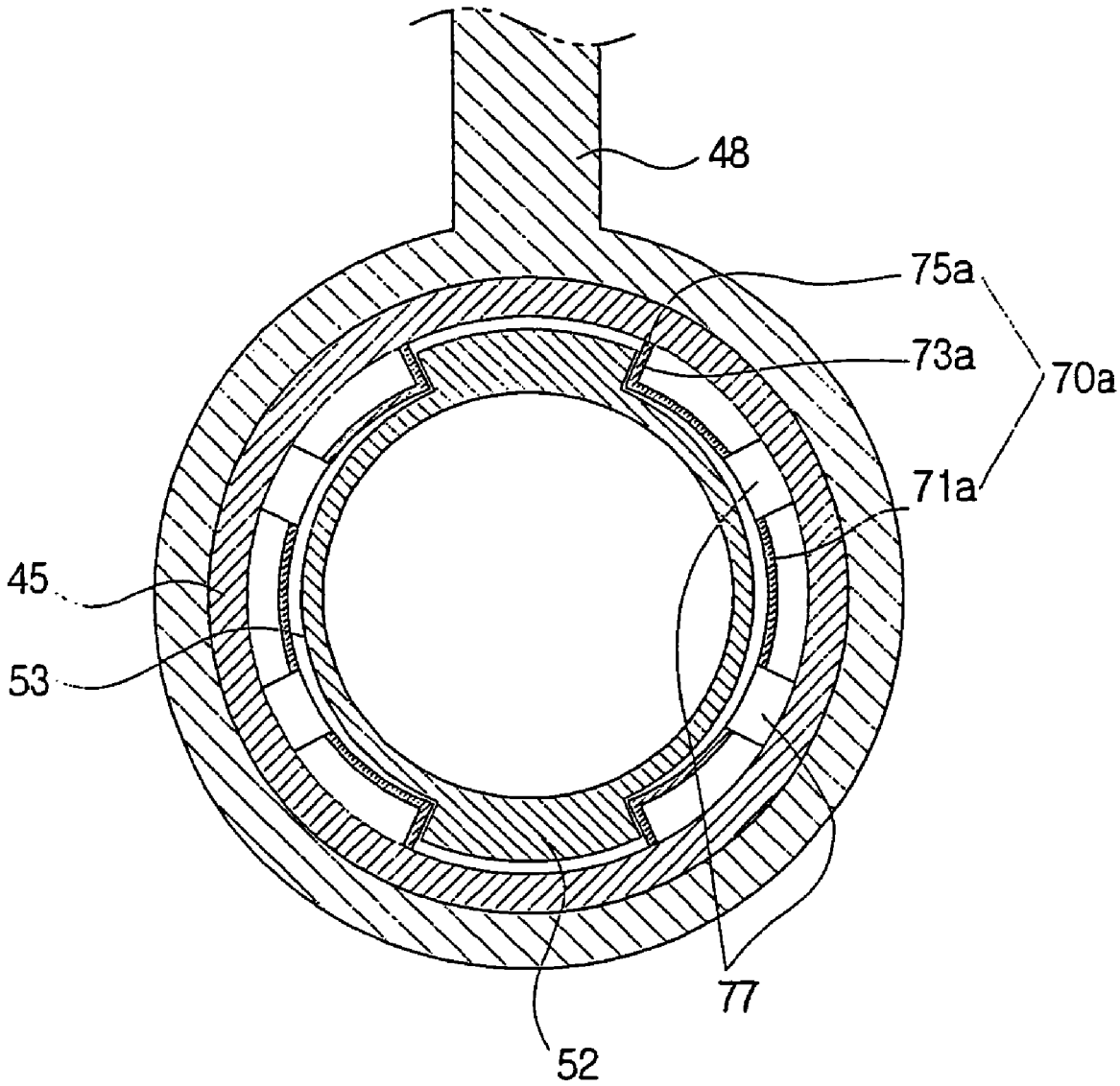
FIG. 11 is a sectional view of the heat roller assembly of FIG. 10.

FIGS. 9 and 10 are a partially enlarged perspective view of a heat roller assembly of an image forming apparatus according to a third embodiment of the present invention, and FIG. 11 is a sectional view of the heat roller assembly of the image forming apparatus of FIG. 10. As is shown therein, at least one protrusion 77 is provided on an elastic member 70*a*.

As is shown in FIGS. 9–11, the elastic member 70*a* has at least one protrusion 77 provided on an elastic portion 71*a* between a pair of bending portions 73*a* and protruding toward the heat roller 45.

According to an aspect of the invention, the protrusion 77 is bent from the elastic portion 71*a* radially to contact the inner circumferential surface of the heat roller 45. That is, the protrusion 77 is bent from the elastic portion 71*a* and contacts the inner circumferential surface of the heat roller 45, thereby pressing the elastic portion 71*a*. Further, the elastic portion 71*a* may be provided with one protrusion 77 (refer to FIG. 9) or two protrusions 77 spaced from each other (refer to FIG. 10). Further, the elastic portion 71*a* may be provided with three or more protrusions 77. According to one aspect, a height of the protrusion 77 protruding from the elastic portion 71*a* is a little lower than a height of a locking portion 75*a*. According to another aspect, the height of the protrusion 77 protruding from the elastic portion 71*a,* is approximately equal to the height of the locking portion 75*a*. Also, according to one aspect, the protrusion 77 is bent from a side of the elastic portion 71*a* facing toward the heat roller 45.

With this configuration, the elastic member 70*a* of the image forming apparatus according to the third embodiment of the present invention is assembled as shown in FIG. 11. That is, the elastic members 70*a* are accommodated in the elastic member accommodating parts 53 provided in each insertion portion 52 of the gear and end caps 51 and 61. Then, the protrusion 77 contacts the inner circumferential surface of the heat roller 45, and the elastic portion 71*a* are inwardly pressed. Then, the locking portions 75*a* of such pressed elastic portion 71*a* are further impacted to the inner circumferential surface of the heat roller 45, thereby further preventing the gear and end caps 51 and 61 from being separated from the heat roller 45 and from rotating relative to the heat roller 45. Two protrusions 77 from each elastic member 70*a* are illustrated in FIG. 11, but three or more protrusions may be provided as described above. Additionally, according to one aspect, the various elastic members 70*a* have differing numbers of protrusions 77. For example, one elastic member 70*a* may have one protrusion 77, and another elastic member 70*a* may have more than one protrusion 77.

Thus, in the image forming apparatus according to the third embodiment of the present invention, the heat roller assembly is easily assembled, and the elastic member further comprises the protrusion, thereby further preventing the gear and end caps 51 and 61 from being separated from the heat roller 45 and from rotating relative to the heat roller 45.

In the above described embodiments, the end caps 61 and 61*a* are provided separately from the heat roller 45 and 45*a,* respectively, and are coupled to the heat roller 45 by the elastic member 70. According to one aspect, the end caps and the heat rollers 45 and 45*a* are formed as a single body.

As is described above, the present invention provides an image forming apparatus comprising a heat roller assembly which is easily assembled and prevents a gear cap from breakaway.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An electrophotographic image forming apparatus including a fixing unit and a driver rotating the fixing unit, the fixing unit comprising:

a heat roller assembly comprising a heat roller, a gear cap coupled to a first end of the heat roller and transmitting rotation to the heat roller, and an elastic member coupling the gear cap with the heat roller; and a pressing roller pressing a recording medium passing between the pressing roller and the heat roller toward the heat roller, the gear cap comprising an insertion portion inserted in the heat roller, and a gear portion integrally provided adjacent to the insertion portion and rotated by the driver, and the elastic member being provided between an outer circumferential surface of the insertion portion of the gear cap and an inner circumferential surface of the heat roller, and coupling the gear cap with the heat roller, wherein the elastic member forms a pair, in the outer circumferential surface of the insertion portion of the gear cap, there is positioned a pair of elastic member accommodating parts, to accommodate the pair of elastic members, and at least one of the pair of the elastic members comprises an elastic portion accommodated in the elastic member accommodating part of the insertion portion and elastically pressed by the heat roller, bending portions positioned on opposite ends of the elastic portion, which, when installed in the heat roller assembly, are bent toward the heat roller, and a locking portion provided in an end of the bending portion and contacting the inner circumferential surface of the heat roller by an elasticity of the elastic portion.

2. The image forming apparatus according to claim 1, wherein the locking portion is hook-shaped, to prevent the gear cap from breaking away from the heat roller and prevent the gear cap from rotating relative to the heat roller.

3. The image forming apparatus according to claim 2, wherein the locking portion comprises material with a hardness higher than material of the inner circumferential surface of the heat roller.

4. The image forming apparatus according to claim 3, wherein:

in the first end of the heat roller, the heat roller has a projection accommodating part positioned in a lengthwise direction of the heat roller, and the gear cap is provided with a projection to be accommodated in the projection accommodating part.

5. The image forming apparatus according to claim 1, wherein the heat roller assembly comprises an end cap coupled by a second elastic member to a second end of the heat roller.

6. An electrophotographic image forming apparatus including a fixing unit and a driver rotating the fixing unit, the fixing unit comprising:

a heat roller assembly comprising a heat roller, a gear cap coupled to a first end of the heat roller and transmitting rotation to the heat roller, and an elastic member coupling the gear cap with the heat roller; and a pressing roller pressing a recording medium passing between the pressing roller and the heat roller toward the heat roller, the gear cap comprising an insertion portion inserted in the heat roller, and a gear portion integrally provided adjacent to the insertion portion and rotated by the driver, and the elastic member being provided between an outer circumferential surface of the insertion portion of the gear cap and an inner circumferential surface of the heat roller, and coupling the gear cap with the heat roller, wherein the elastic member forms a pair, in the outer circumferential surface of the insertion portion of the gear cap, there is positioned a pair of elastic member accommodating parts, to accommodate the pair of elastic members, at least one of the pair of the elastic members comprises an elastic portion accommodated in the elastic member accommodating part of the insertion portion and elastically pressed by the heat roller, bending portions positioned on opposite ends of the elastic portion, which, when installed in the heat roller assembly, are bent toward the heat roller, and a locking portion provided in an end of the bending portion and contacting the inner circumferential surface of the heat roller by an elasticity of the elastic portion, and at least one of the pair of the elastic members further comprises at least one protrusion provided on the elastic portion between the pair of bending portions and protruding toward the heat roller.

7. The image forming apparatus according to claim 6, wherein the protrusion is bent from the elastic portion and contacts the inner circumferential surface of the heat roller to press the elastic portion.

8. A heat roller assembly of an electrophotographic image forming apparatus including a driver, the heat roller assembly comprising:

a heat roller;

a gear cap having an insertion portion inserted into a first end of the heat roller and having a pair of elastic member accommodating parts, and a gear portion adjacent to the insertion portion and transmitting rotary motion from the driver to the heat roller assembly; and a pair of elastic members disposed, respectively, in the pair of elastic member accommodating parts and coupling the gear cap to the first end of the heat roller and to prevent the gear cap from rotating relative to the heat roller, wherein at least one of the pair of the elastic members comprises an elastic portion accommodated in the corresponding elastic member accommodating part of the insertion portion and elastically pressed by the heat roller, bending portions positioned on opposite ends of the elastic portion, which, when installed in the heat roller assembly, are bent toward the heat roller, and a locking portion provided in an end of the bending portion and contacting an inner circumferential surface of the heat roller by an elasticity of the elastic portion.

9. The heat roller assembly according to claim 8, wherein each of the elastic member accommodating parts is a recess positioned on an outer circumferential surface of the insertion portion.

10. The heat roller assembly according to claim 8, wherein:

the heat roller assembly further comprises a heater disposed in the heat roller, a power supply, and an end cap capping a second end of the heat roller; and the gear cap and the end cap each comprise an electrode connected to the power supply to supply power to the heater.

11. The heat roller assembly according to claim 10, wherein the end cap and the heat roller are integrally formed.

12. The heat roller assembly according to claim 10, wherein the end cap comprises:

an insertion portion inserted into a second end of the heat roller and having an elastic member accommodating part, to accommodate a second elastic member, to couple the end cap to the second end of the heat roller.

13. The heat roller assembly according to claim 8, wherein:

each of the elastic member accommodating parts is a recess positioned on an outer circumferential surface of the insertion portion; and when the elastic member is accommodated in the corresponding elastic member accommodating part, the bending portions extend out of the elastic member accommodating part.

14. The heat roller assembly according to claim 8, wherein the elastic portion is arc-shaped.

15. The heat roller assembly according to claim 8, wherein the locking portion is hook-shaped.

16. The heat roller assembly according to claim 15, wherein when the elastic portion is accommodated in the elastic portion accommodating part and the insertion portion is inserted into the first end of the heat roller, the locking portion forms an acute angle with respect to the inner circumferential surface of the heat roller in an inserting direction, to aid insertion into the heat roller.

17. The heat roller assembly according to claim 16, wherein the locking portion forms an obtuse angle with respect to the inner circumferential surface of the heat roller in a removing direction opposite the inserting direction, to prevent removal from the heat roller.

18. The heat roller assembly according to claim 8, wherein the locking portion has a hardness greater than a hardness of the inner circumferential surface of the heat roller.

19. The heat roller assembly according to claim 18, wherein:

the heat roller is made of aluminum; and the locking portion is made of steel.

20. The heat roller assembly according to claim 8, wherein:

the insertion portion comprises a projection; and the first end of the heat roller has a projection accommodating part accommodating the projection when the gear cap is inserted into the first end of the heat roller.

21. A heat roller assembly of an electrophotographic image forming apparatus including a driver, the heat roller assembly comprising:

a heat roller;

a gear cap having an insertion portion inserted into a first end of the heat roller and having an elastic member accommodating part, and a gear portion adjacent to the insertion portion and transmitting rotary motion from the driver to the heat roller assembly; and an elastic member disposed in the elastic member accommodating part and coupling the gear cap to the first end of the heat roller and to prevent the gear cap from rotating relative to the heat roller, wherein the elastic portion comprises an elastic portion, a bending portion positioned at an end of the elastic portion and bent away from the elastic portion, a locking portion positioned at an end of the bending portion and contacting an inner circumferential surface of the heat roller due to an elasticity of the elastic portion, to couple the gear cap to the first end of the heat roller and to prevent the gear cap from rotating relative to the heat roller, and a protrusion extending from the elastic portion and contacting the inner circumferential surface of the heat roller when the gear cap is inserted in the first end of the heat roller.

22. The heat roller assembly according to claim 21, wherein with respect to the elastic portion, a height of the protrusion is less than a height of the locking portion.

23. The heat roller assembly according to claim 21, wherein with respect to the elastic portion, a height of the protrusion is approximately equal to a height of the locking portion.

24. The heat roller assembly according to claim 21, wherein the protrusion extends from a side of the elastic portion facing the inner circumferential surface of the heat roller.

25. The heat roller assembly according to claim 21, wherein the protrusion forms a plurality of protrusions extending from the elastic portion and contacting the inner circumferential surface of the heat roller when the gear cap is inserted in the first end of the heat roller.

26. A heat roller assembly of an electrophotographic image forming apparatus including a driver, the heat roller assembly comprising:

a heat roller;

a pair of end caps, respectively engaging opposite ends of the heat roller, each end cap having an insertion portion inserted into one of the opposite ends of the heat roller, each insertion portion having a plurality of elastic member accommodating parts; and a plurality of elastic members corresponding to the plurality of elastic member accommodating parts, wherein one of the pair of end caps having a gear portion transmitting rotary motion from the driver to the heat roller assembly, the plurality of elastic members being respectively disposed in the elastic member accommodating parts and coupling the end caps to the respective opposite end of the heat roller, to prevent the end caps from rotating relative to the heat roller, and at least one of the elastic members comprises an elastic portion accommodated in the elastic member accommodating part of the insertion portion and elastically pressed by the heat roller, bending portions positioned on opposite ends of the elastic portion, which, when installed in the heat roller assembly, are bent toward the heat roller, and a locking portion provided in an end of the bending portion and contacting the inner circumferential surface of the heat roller by an elasticity of the elastic portion.

* * * * *